US008579597B2

(12) United States Patent
Byun et al.

(10) Patent No.: US 8,579,597 B2
(45) Date of Patent: Nov. 12, 2013

(54) VARIABLE CAPACITY TYPE ROTARY COMPRESSOR

(75) Inventors: Sang-Myung Byun, Changwon (KR); Sang-Mo Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 387 days.

(21) Appl. No.: 13/054,874

(22) PCT Filed: Jul. 22, 2009

(86) PCT No.: PCT/KR2009/004061

§ 371 (c)(1),
(2), (4) Date: Jan. 19, 2011

(87) PCT Pub. No.: WO2010/011082

PCT Pub. Date: Jan. 28, 2010

(65) Prior Publication Data

US 2011/0123361 A1 May 26, 2011

(30) Foreign Application Priority Data

Jul. 22, 2008 (KR) ..... 10-2008-0071207

(51) Int. Cl.
*F03C 2/00* (2006.01)
*F04C 14/24* (2006.01)
*F04B 49/22* (2006.01)

(52) U.S. Cl.
USPC ..... 417/213; 417/310; 417/440; 418/15; 418/23

(58) Field of Classification Search
USPC ..... 417/213, 218, 310, 440; 418/23, 26, 15; 62/228.1
See application file for complete search history.

(56) References Cited

U.S. PATENT DOCUMENTS 6,716,007 B2 * 4/2004 Kim et al. ..... 418/23
6,796,773 B1 * 9/2004 Choi et al. ..... 417/218
7,540,727 B2 * 6/2009 Byun et al. ..... 418/26
7,611,341 B2 * 11/2009 Byun et al. ..... 418/11
7,775,782 B2 * 8/2010 Choi et al. ..... 418/23

(Continued)

FOREIGN PATENT DOCUMENTS

CN 1380947 11/2002
JP 10-141267 5/1998

(Continued)

OTHER PUBLICATIONS

International Search Report issued in PCT Application No. PCT/KR2009/004061 dated Nov. 13, 2009.

(Continued)

*Primary Examiner* — Charles Freay
*Assistant Examiner* — Nathan Zollinger
(74) *Attorney, Agent, or Firm* — Ked & Associates LLP

(57) ABSTRACT

A variable capacity type rotary compressor, in which a refrigerant sucked in via one suction pipe can be alternately sucked into each compression space via a communication passage between cylinders so as to reduce a number of components and a number of assembly processes, thereby reducing fabrication costs. A refrigerant within an idling cylinder is prevented from flowing back into another cylinder so as to improve performance of the compressor. A welding space can be ensured when connecting connection pipes so as to realize a welding automation, thereby further reducing the fabrication cost, and a mode switching valve is stably fixed to an appropriate position so as to attenuate noise due to vibration of compressor.

14 Claims, 9 Drawing Sheets

(56) References Cited

U.S. PATENT DOCUMENTS

| | | | | |
|---|---|---|---|---|
| 7,798,791 | B2 * | 9/2010 | Byun et al. | 418/26 |
| 7,976,287 | B2 * | 7/2011 | Hwang et al. | 417/213 |
| 8,186,979 | B2 * | 5/2012 | Byun et al. | 418/26 |
| 8,206,128 | B2 * | 6/2012 | Onoda | 417/216 |
| 8,251,683 | B2 * | 8/2012 | Byun et al. | 418/11 |
| 2004/0009083 | A1 * | 1/2004 | Kim et al. | 418/23 |
| 2004/0175274 | A1 * | 9/2004 | Cho et al. | 417/213 |
| 2006/0090488 | A1 * | 5/2006 | Hwang | 62/175 |
| 2008/0193310 | A1 * | 8/2008 | Byun et al. | 418/23 |
| 2010/0017037 | A1 * | 1/2010 | Nam et al. | 700/275 |
| 2011/0123361 | A1 * | 5/2011 | Byun et al. | 417/199.1 |

FOREIGN PATENT DOCUMENTS

| | | | |
|---|---|---|---|
| JP | 11-182434 | | 7/1999 |
| KR | 10-0585807 | | 5/2006 |
| WO | WO 2006090977 | A1 * | 8/2006 |
| WO | WO 2008/023962 | | 2/2008 |

OTHER PUBLICATIONS

Chinese Office Action dated Jan. 23, 2013.

* cited by examiner

VARIABLE CAPACITY TYPE ROTARY COMPRESSOR

TECHNICAL FIELD

The present invention relates to a variable capacity type rotary compressor capable of being selectively operated in a saving mode or a power mode.

BACKGROUND ART

In general, a refrigerant compressor is applied to a vapor compression type refrigerating cycle (hereinafter, referred to as 'refrigerating cycle'), such as a refrigerator or an air conditioner. A constant-speed type compressor driven at constant speed and an inverter type compressor capable of controlling rotation speed have been introduced as the refrigerant compressor.

The refrigerant compressors are categorized as follows. A refrigerant compressor, in which a driving motor (typically, an electric motor) and a compression part operated by the driving motor are all installed in an inner space of a hermetic casing, is referred to as a hermetic type compressor, and a compressor of which the driving motor is separately installed outside the casing is referred to as an open type compressor. Home or commercial cooling apparatuses usually employ the hermetic type compressor. Such hermetic type compressors may be categorized into a reciprocating type, a scroll type, a rotary type and the like according to a refrigerant compression mechanism.

The rotary compressor compresses a refrigerant by use of a rolling piston eccentrically rotating in a compression space of a cylinder and a vane contacted with a rolling piston for partitioning the compression space of the cylinder into a suction chamber and a discharge chamber. In recent time, a variable capacity type rotary compressor capable of varying a cooling capacity of the compressor according to the change in a load has been introduced. Well-known technologies for varying the cooling capacity of the compressor include applying an inverter motor, and varying a volume of a compression chamber by bypassing part of a compressed refrigerant out of a cylinder. However, for employing the inverter motor, a driver for driving the inerter motor is about 10 times as expensive as a driver of a constant-speed motor, thereby rising a fabrication cost of the compressor. On the other hand, for bypassing the refrigerant, a piping system becomes complicated and accordingly a flow resistance of the refrigerant is increased, thereby lowering efficiency of the compressor.

Considering such drawbacks, a so-called independent suction type variable capacity rotary compressor (hereinafter, referred to as 'independent suction type rotary compressor'), in which a plurality of cylinders are provided and at least one of them is allowed for idling, is introduced. In this case, a suction pipe is independently installed in each of the plurality of cylinders such that both cylinders are operated independent of each other.

However, for the independent suction type rotary compressor, since the suction pipes should independently be connected to both cylinders, the number of assembly processes is drastically increased, thereby rising the fabricating cost of the compressor.

As both of the cylinders are connected by the corresponding suction pipes, a refrigerant of high temperature flows backwardly into an idling cylinder, thereby lowering the function of the compressor.

Further, in case of a plurality of suction pipes being connected, they are positioned near other members, and thereby a welding space therefor is not ensured. Accordingly, an automatic assembly process is not available to be performed, thereby further increasing the fabricating cost.

In addition, a mode switching device for varying the capacity of the compressor is installed outside the casing, accordingly it is vibrated when the compressor is vibrated, thereby aggravating the vibration of the compressor.

DISCLOSURE

[Technical Solution]

Therefore, an object of the present invention is to provide a variable capacity type rotary compressor capable of enhancing efficiency thereof by improving the ratio of lowering the cooling capacity in a saving mode.

Another object of the present invention is to provide a variable capacity type rotary compressor capable of easily and simply varying the capacity of the compressor and also decreasing a fabricating cost by reducing the number of components required therefor.

Another object of the present invention is to provide a variable capacity type rotary compressor capable of preventing beforehand a mode switching device for varying the capacity of the compressor from aggravating vibration of the compressor.

To achieve these and other advantages and in accordance with the purpose of the present invention, as embodied and broadly described herein, there is provided a variable capacity type rotary compressor including, a casing having a hermetic inner space, an accumulator coupled to one side of the casing via a suction pipe, at least one compression unit installed in the inner space of the casing with being connected to the accumulator via the suction pipe and configured to compress a refrigerant sucked via the accumulator, a driving motor installed in the inner space of the casing and configured to drive the compression unit, and a mode switching valve installed outside the casing and configured to vary an operation mode of the compression unit, wherein the mode switching valve is fixed to the accumulator to be disposed between lower and upper ends of the accumulator.

Here, the accumulator may be coupled to the casing at least two fixed positions in a lengthwise direction of the accumulator.

The mode switching value may be fixed to have a fixed position between the fixed positions between the casing and the accumulator.

The mode switching valve may be installed at a position at which a to distance L2 between a reference height CL at which the suction pipe is coupled to the casing and a center of the mode switching valve is shorter than a distance L1 between the reference height CL and an upper end of the accumulator and greater than a distance L3 between the reference height CL and a lower end of the accumulator.

The accumulator may coupled to be positioned higher than the center of the compression space of the compression unit.

The mode switching valve may be configured as a three-way valve having two inlets and one outlet, the two inlets and one outlet being fixed to one ends of different connection pipes, wherein at least one of the connection pipes may be fixed to the casing and another end of the one connection pipe may be fixed to an outer circumferential surface of the suction pipe.

Here, the suction pipe may be curved to have a longitudinal portion and a horizontal portion, and the connection pipe may be connected to the longitudinal portion of the suction pipe.

Here, the compression unit may include a plurality of cylinders installed in the inner space of the casing and having compression spaces, respectively, a plurality of rolling pistons orbited within the compression spaces of the cylinders to compress a refrigerant, and a plurality of vanes configured to partition the compression space of each cylinder into a suction space and a discharge space together with the rolling pistons.

A chamber may be disposed in one of the cylinders and configured to support the vane by a refrigerant of suction pressure or discharge pressure filled therein, the chamber being isolated within the inner space of the casing.

Here, the chamber may be connected to the outlet of the mode switching valve via the connection pipe.

At least one of the vanes may be restricted by pressure of the inner space of the casing.

Here, the plurality of cylinders may be provided with suction holes, respectively, which are communicated with each other via a communication passage, and the suction pipe may be connected to the communication passage such that a refrigerant is distributed into the plurality of cylinders.

Advantageous Effect

The variable capacity type rotary compressor according to the present invention can facilitate controlling of capacity variation and simplify a piping structure. Also, upon applying such compressor to an air conditioner, a mode switching is facilitated so as to improve comfortableness and energy saving and reduce interference with other pipes, which allows improvement of the assembly of the air conditioner and reduction of the number of valves, thereby decreasing the fabricating cost. Also, a modularized valve is fixed to a casing or accumulator, so as to prevent beforehand the increase in compressor vibration due to the valve and standardize the piping assembly, thereby improving productivity.

MODE FOR INVENTION

Description will now be given in detail of a variable capacity type rotary compressor in accordance with one embodiment of the present invention, with reference to the accompanying drawings.

Figure 1:
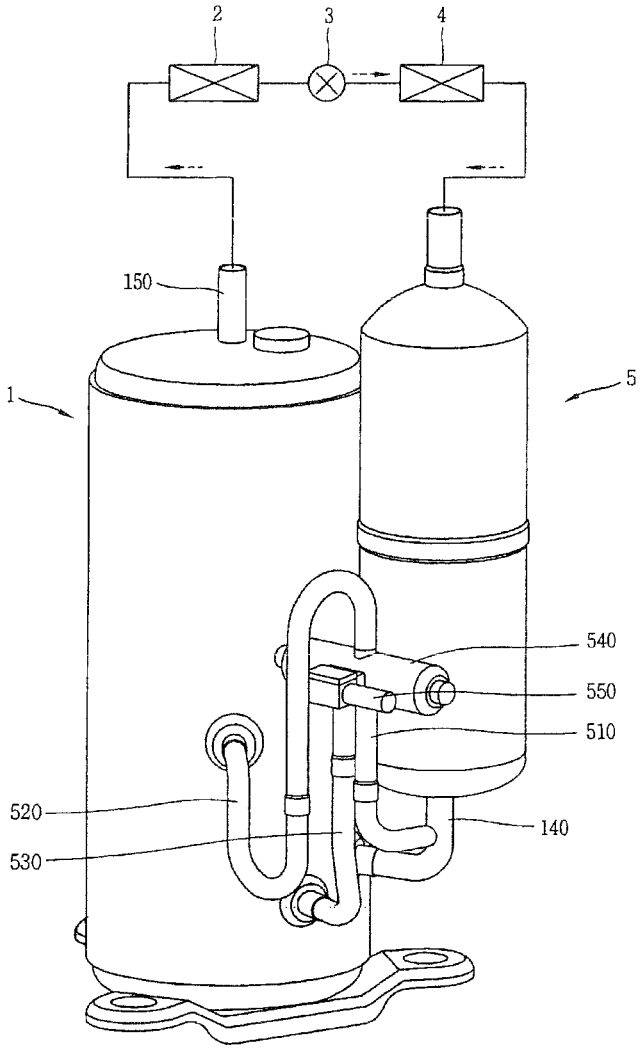
FIG. 1 is a schematic view of a refrigerating cycle including a variable capacity type rotary compressor in accordance with the present invention.

As shown in FIG. 1, a variable capacity type rotary compressor 1 according to the present invention may be configured such that a suction side thereof is connected to an outlet side of an evaporator 4 and simultaneously a discharge side thereof is connected to an inlet side of a condenser 2 so as to form a part of a closed loop refrigerating cycle including the condenser 2, an expansion apparatus 3 and the evaporator 4. An accumulator 5 for separating a refrigerant carried from the evaporator 4 to the compressor 1 into a gaseous refrigerant and a liquid refrigerant may be connected between the discharge side of the evaporator 4 and the inlet side of the compressor 1.

The compressor 1, as shown in FIG. 1, may include a motor part 200 installed at an upper side of an inner space of a hermetic casing 100 for generating a driving force, and first and second compression parts 300 and 400 installed at a lower side of the inner space of the casing 100 for compressing a refrigerant by the driving force generated from the motor part 200. A mode switching unit 500 for switching an operation mode of the compressor 1 such that the second compression part 400 is idled if necessary may be installed outside the casing 100.

The casing 100 may have the inner space maintained in a discharge pressure state by a refrigerant discharged from the first and second compression parts 300 and 400 or from the first compression part 300. One gas suction pipe 140 through which a refrigerant is sucked between the first and second compression parts 300 and 400 may be connected to a circumferential surface of a lower portion of the casing 100. A discharge pipe 150 through which the refrigerant discharged after being compressed in the first and second compression parts 300 and 400 flows into a cooling system may be connected to an upper end of the casing 100. The gas suction pipe 140 may be inserted into an intermediate connection pipe (not shown), which is inserted into a communication passage 131 of the intermediate bearing 130 to be explained later, so as to be welded for coupling.

The motor part 200 may include a stator 210 fixed onto an inner circumferential surface of the casing 100, a rotor 220 rotatably disposed in the stator 210, and a rotation shaft 230 shrink-fitted with the rotor 220 so as to be rotated together with the rotor 220. The motor part 200 may be implemented as a constant-speed motor or an inverter motor. However, an operation mode of the compressor can be switched by idling any one of the first and second compression parts 300 and 400, if necessary, even with employing the constant-speed motor, considering a fabricating cost.

The rotation shaft 230 may include a shaft portion 231 coupled to the rotor 220, and a first eccentric portion 232 and a second eccentric portion 233 both disposed at a lower end section of the shaft portion 231 to be eccentric to both right and left sides. The first eccentric portion 232 and the second eccentric portion 233 may be symmetric to each other with a phase difference of about 180°, and rotatably coupled to a first rolling piston 340 and a second rolling piston 430, respectively.

The first compression part 300 may include a first cylinder 310 formed in an annular shape and installed inside the casing 100, a first rolling piston 320 rotatably coupled to the first eccentric portion 232 of the rotation shaft 230 and configured to compress a refrigerant by being orbited in a first compression space V1 of the first cylinder 310, a first vane 330 movably coupled to the first cylinder 310 in a radial direction, with a sealing surface of its one side being contacted with an outer circumferential surface of the first rolling piston 320, and configured to partition the first compression space V1 of the first cylinder 310 into a first suction chamber and a first discharge chamber, and a vane spring 340 configured as a compression spring for elastically supporting a rear side of the first vane 330. Unexplained reference numeral 350 denotes a first discharge valve, and 360 denotes a first muffler.

The second compression part 400 may include a second cylinder 410 formed in an annular shape and installed below the first cylinder 310 inside the casing 100, a second rolling piston 420 rotatably coupled to the second eccentric portion 233 of the rotation shaft 230 and configured to compress a refrigerant by being orbited in a second compression space V2 of the second cylinder 410, and a second vane 430 movable coupled to the second cylinder 410 in a radial direction, and contacted with an outer circumferential surface of the second rolling piston 420 so as to partition the second compression space V2 of the second cylinder 410 into a second suction chamber and a second discharge chamber or spaced from the outer circumferential surface of the second rolling piston 429 so as to communicate the second suction chamber with the second discharge chamber. Unexplained reference numeral 440 denotes a second discharge valve, and 450 denotes a second muffler.

Here, an upper bearing plate (hereinafter, referred to as 'upper bearing') 100 covers the upper side of the first cylinder 310, and a lower bearing plate (hereinafter, referred to as 'lower bearing') 120 covers the lower side of the second cylinder 410. Also, an intermediate bearing plate (hereinafter, referred to as 'intermediate bearing') 130 is interposed between the lower side of the first cylinder 310 and the upper side of the second cylinder 410 so as to support the rotation shaft 230 in a shaft direction with forming the first compression space V1 and the second compression space V2.

Figure 3:
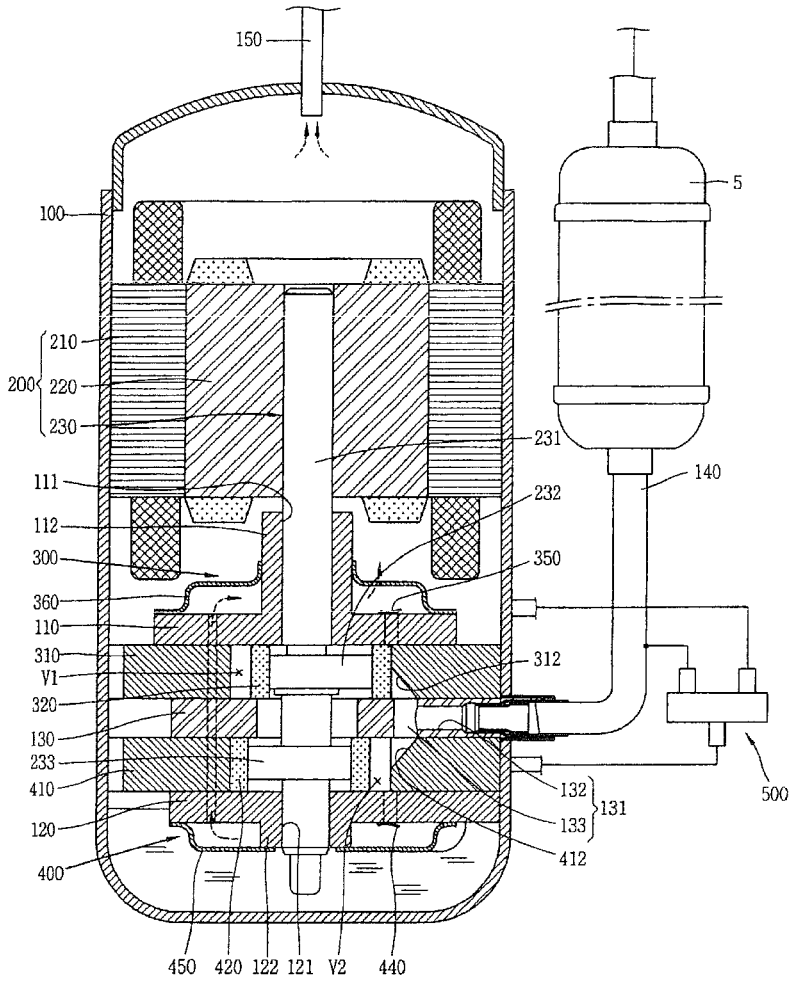
FIG. 3 is a longitudinal cross-sectional view showing an inside of the rotary compressor in accordance with FIG. 1, by being longitudinally cut based upon a suction hole.
Figure 4:
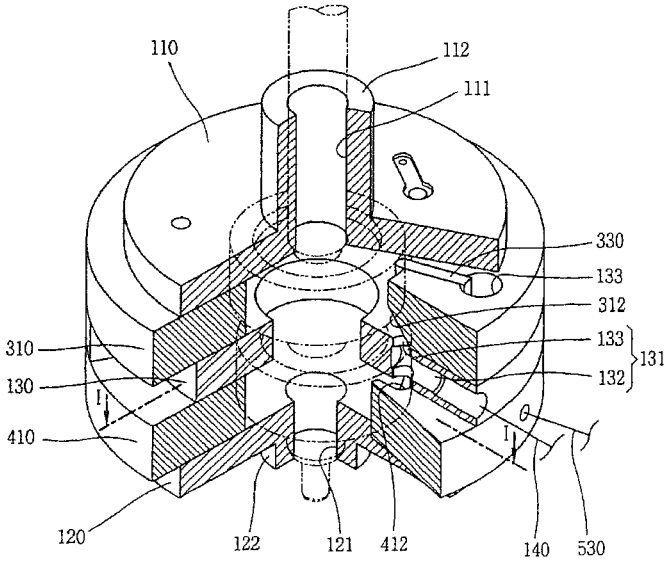
FIG. 4 is a perspective view showing a broken compression part of the rotary compressor in accordance with FIG. 1.

As shown in FIGS. 3 and 4, the upper bearing 110 and the lower bearing 120 are formed in a disc shape, and shaft supporting portions 112 and 122 having shaft holes 111 and 121 for supporting the shaft portion 231 of the rotation shaft 230 in a radial direction may protrude from respective centers thereof. The intermediate bearing 130 is formed in an annular shape with an inner diameter large enough to allow the eccentric portions of the rotation shaft 230 to be penetrated therethrough. A communication passage 131 through which a first suction hole 312 and a second suction hole 412 to be explained later can be communicated with the gas suction pipe 140 may be formed at one side of the intermediate bearing 130.

The communication passage 131 of the intermediate bearing 130 may be provided with a horizontal path 132 formed in a radial direction to be communicated with the gas suction pipe 140, and a longitudinal path 133 formed at an end of the horizontal path 132 and formed through in a shaft direction for communicating the first suction hole 312 and the second suction hole 412 with the horizontal path 132. The horizontal path 132 may be recessed by a prescribed depth from an outer circumferential surface of the intermediate bearing 130 toward an inner circumferential surface thereof, namely, by a depth not completely enough to be communicated with the inner circumferential surface of the intermediate bearing 130.

The first cylinder 310 may be provided with a first vane slot 311 formed at one side of its inner circumferential surface forming the first compression space V1 for allowing the first vane 330 to be linearly reciprocated, a first suction hole 312 formed at one side of the first vane slot 311 for inducing a refrigerant into the first compression space V1, and a first discharge guiding groove (not shown) formed at another side of the first vane slot 311 by chamfering an edge at an opposite side of the first suction hole 312 with an inclination angle, so as to guide a refrigerant to be discharged into an inner space of the first muffler 360.

The second cylinder 410 may be provided with a second vane slot 411 formed at one side of its inner circumferential surface forming the second compression space V2 for allowing the second vane 430 to be linearly reciprocated, a second suction hole 412 formed at one side of the second vane slot 411 for inducing a refrigerant into the second compression space V2, and a second discharge guiding groove (not shown) formed at another side of the second vane slot 411 by chamfering an edge at an opposite side of the second suction hole 412 with an inclination angle so as to guide a refrigerant to be discharged into an inner space of the second muffler 450.

The first suction hole 312 may be formed with an inclination angle by chamfering an edge of a lower surface of the first cylinder 310, contacted with an upper end of the longitudinal path 133 of the intermediate bearing 130, toward the inner circumferential surface of the first cylinder 310.

The second suction hole 412 may be formed with an inclination angle by chamfering an edge of an upper surface of the second cylinder 410, contacted with a lower end of the longitudinal path 133 of the intermediate bearing 130, toward the inner circumferential surface of the second cylinder 410.

Figure 5:
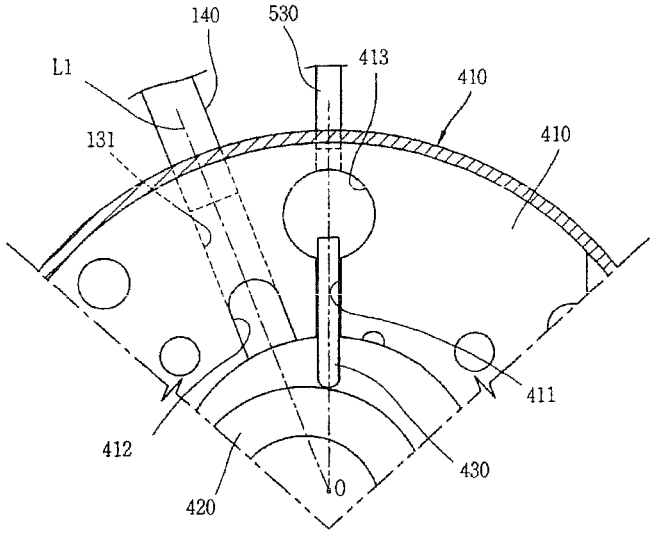
FIG. 5 is a horizontal cross-sectional view showing an appropriate position of the suction hole in the rotary compressor in accordance with FIG. 4.

Here, as shown in FIG. 5, the first suction hole 312 and the second suction hole 412 may be formed such that, from a plane projection image, central lines L1 and L2 thereof in a radial direction intersect with shaft centers O of the cylinders 310 and 410 having the suction holes 312 and 412, respectively. Also, the first suction hole 312 and the second suction hole 412 may be symmetric to each other on a straight line in the shaft direction based upon the communication passage 131.

Further, referring to FIG. 3, the first vane slot 311 may be formed by cutting (recessing) the first cylinder 310 into a preset depth in a radial direction such that the first vane 330 can be linearly reciprocated. A through hole 313, as shown in FIG. 4, may be formed through a rear side of the first vane slot 311, namely, a portion on an outer circumferential surface of the first cylinder 310, so as to be communicated with the inner space of the casing 100. A vane spring 340 may be installed in the through hole 313 of the first cylinder 310.

The second vane slot 411 may be formed by cutting (recessing) the second cylinder 410 into a preset depth in a radial direction such that the second vane 430 can be linearly reciprocated. A vane chamber 413 may be formed through a rear side of the second vane slot 411, namely, a portion on an outer circumferential surface of the second cylinder 410, so as to be communicated with a common connection pipe 530 to be explained later. The vane chamber 413 may be hermetically coupled by the intermediate bearing 130 and the lower bearing 120 contacting with its upper and lower surfaces so as to be isolated within the inner space of the casing 100.

An intermediate connection pipe (not shown) may be press-fitted to the vane chamber 413 such that a front side thereof can be communicated with the front side of the vane chamber 413 and a rear side thereof can be welded with the common connection pipe 530. The vane chamber 413 may have a preset inner volume such that the rear surface of the second vane 430 can serve as a pressed surface by a refrigerant supplied via the common connection pipe 530 even if the second vane 430 is completely retracted to be accommodated within the second vane slot 411.

Figure 6:
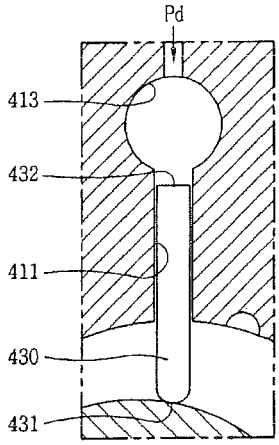
FIG. 6 is a horizontal cross-sectional view showing a second vane in the rotary compressor in accordance with FIG. 4.
Figure 7:
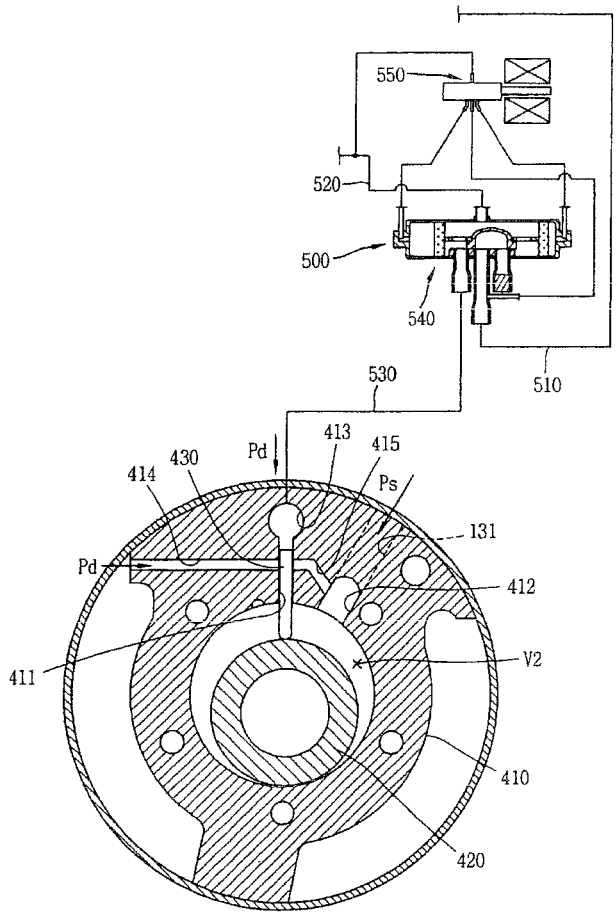
FIG. 7 is a view showing restricting passages for restricting the second vane in the rotary compressor in accordance with FIG. 1, which is a view taken along the line I-I of FIG. 4.

Here, as shown in FIG. 6, the pressed surface 432 of the second vane 430 is supported by a refrigerant of a suction pressure or a refrigerant of a discharge pressure filled in the vane chamber 413 such that a sealing surface thereof comes in contact with or is spaced from the second rolling piston 420 according to an operation mode of the compressor. Accordingly, in order to prevent beforehand compressor noise or efficiency degradation due to the vibration of the second vane 430, the second vane 430 should be restricted within the second vane slot 411 in a particular operation mode of the compressor, i.e., in a saving mode. To this end, a restriction method for the second vane using internal pressure of the casing 100, as shown in FIG. 7, may be proposed.

For instance, the second cylinder 410 may be provided with a high pressure side vane restricting passage (hereinafter, referred to as 'first restricting passage') 414 orthogonal to a motion direction of the second vane 430 or formed in a direction at least having a stagger angle with respect to the second vane 430. The first restricting passage 414 allows the inside of the casing 100 to be communicated with the second vane slot 411 such that a refrigerant of discharge pressure filled in the inner space of the casing 100 pushes the second vane 430 towards an opposite vane slot surface, thereby restricting the second vane 430. A lower pressure side vane restricting passage (hereinafter, referred to as 'second restricting passage') for allowing the second vane slot 411 to be communicated with the second suction hole 412 may be formed at an opposite side of the first restricting passage 414. The second restricting passage 415 generates a pressure difference from the first restricting passage 414 such that a refrigerant of discharge pressure introduced via the first restricting passage 414 flows through the second restricting passage 415, thereby quickly restricting the second vane 430.

The first restricting passage 414 may be positioned near the discharge guiding groove (no reference numeral given) of the second cylinder 410 based upon the second vane 430 and formed through the outer circumferential surface of the second cylinder 410 to the center of the second vane slot 411. The first restricting passage 414 may be formed to be two-stepped by using a two-stepped drill such that a portion of the first restricting passage 414 near the second vane slot 411 can be narrower. Also, an outlet of the first restricting passage 414 may be positioned approximately in the middle of the second vane slot 411 in a lengthwise direction of the second vane slot 411 such that a linear motion of the second vane 430 can be stably achieved. The first restricting passage 414 may be formed at a position where it can be communicated with the vane chamber 413 via a gap between the second vane 430 and the second vane slot 411 in a power mode of the compressor, such that the refrigerant of discharge pressure can be introduced into the vane chamber 413 via the first restricting passage 414, thereby increasing the rear side pressure of the second vane 430. However, in the saving mode of the compressor, when the second vane 430 is restricted, the first restricting passage 414 is communicated with the vane chamber 413 so as to increase the pressure of the vane chamber 413, and accordingly the second vane 430 can be pressed by the pressure, which may cause vibration of the second vane 430. Accordingly, the first restricting passage 414 may preferably be formed to be positioned within a reciprocating range of the second vane 430.

The first restricting passage 414 may have a sectional area equal to or smaller than a sectional area of a pressed surface 432 of the second vane 430 by the pressure from the vane chamber 413, thereby preventing the excessive restriction of the second vane 430. For example, when dividing the sectional area of the first restricting passage 414 by a vane area of the second vane 430, namely, a vane area of a side surface thereof to which the restricting pressure is applied, the sectional area of the first restricting passage 414 may preferably be in a specific range, which thusly allows a minimization of noise occurred by a mode switching.

Although not shown in the drawing, the first restricting passage 414 may be recessed into both upper and lower surfaces of the second cylinder 410 by a preset depth. Alternatively, the first restricting passage 414 may be recessed into or penetrated through the intermediate bearing 130 or the lower bearing 120 coupled to the upper and lower surfaces of the second cylinder 410. Here, if the second restricting passage 415 is recessed into the upper surface of the lower bearing 120 or the lower surface of the intermediate bearing 130, the second restricting passage 415 may be formed simultaneously when sintering the second cylinder 410 or each bearing 120 and 130, thereby reducing the fabricating cost.

The second restricting passage 415 may preferably be disposed on the same line as the first restricting passage 414, if possible, so as to cause the pressure difference between discharge pressure and suction pressure at both side surfaces orthogonal to a motion direction of the second vane 430, thereby closely adhering the second vane 430 to the second vane slot 411 by the pressure difference. However, since the second suction hole 412 is inclined in the shaft direction, the second restricting passage 314 may be inclined or curved so as to be communicated with the second suction hole 412.

The second restricting passage 415 may preferably be formed at a position where it can be communicated with the vane chamber 413 via a gap between the second vane 430 and the second vane slot 411 in the saving mode of the compressor. However, when the second vane 430 moves forward in the power mode of the compressor, the second restricting passage 415 is communicated with the vane chamber 413 and accordingly, a refrigerant of discharge pressure Pd filled in the vane chamber 413 may be leaked into the second suction hole 412 so as not to sufficiently support the second vane 430. Hence, the second restricting passage 415 may preferably be formed to be positioned within the is reciprocating range of the second vane 430.

Figure 2:
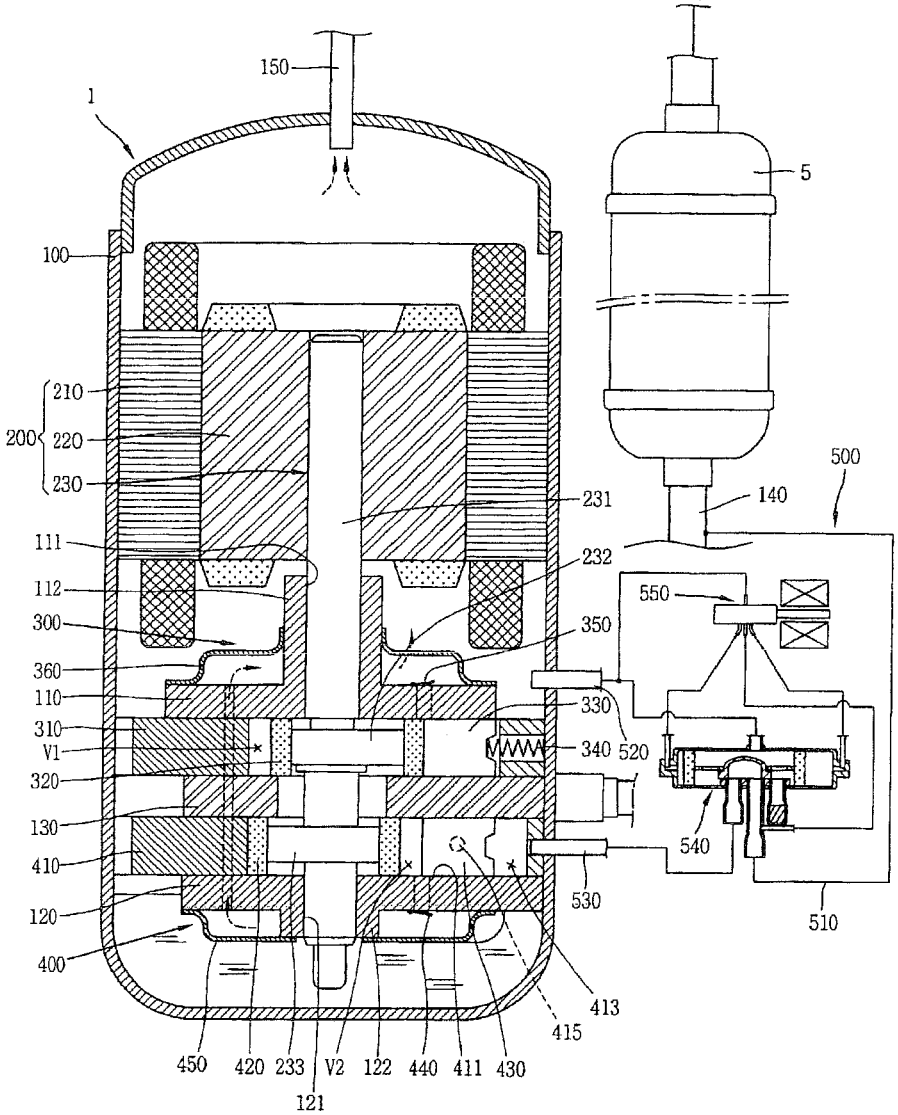
FIG. 2 is a longitudinal cross-sectional view showing an inside of the rotary compressor in accordance with FIG. 1 by being longitudinally cut based upon a vane.

The mode switching unit 500, as shown in FIGS. 1 and 2, may include a low pressure side connection pipe 510 having one end diverged from the gas suction pipe 140, a high pressure side connection pipe 520 having one end connected to the inner space of the casing 100, a common connection pipe 530 having one end connected to the vane chamber 413 of the second cylinder 410 so as to be selectively communicated with the low pressure side connection pipe 510 and the high pressure side connection pipe 520, a first mode switching valve 540 connected to the vane chamber 413 of the second cylinder 410 via the common connection pipe 530, and a second mode switching valve 550 connected to the first mode switching valve 540 for controlling the switching operation of the first switching valve 540.

Figure 8:
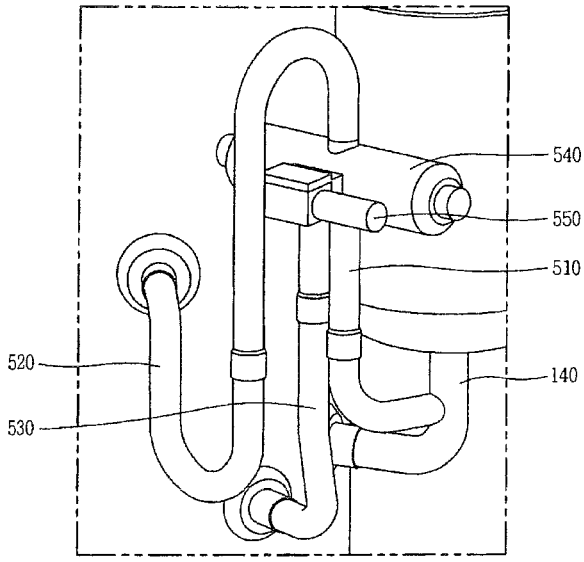
FIG. 8 is an enlarged perspective view showing positions of a suction pipe and each connection pipe in the rotary compressor in accordance with FIG. 1.
Figure 9:
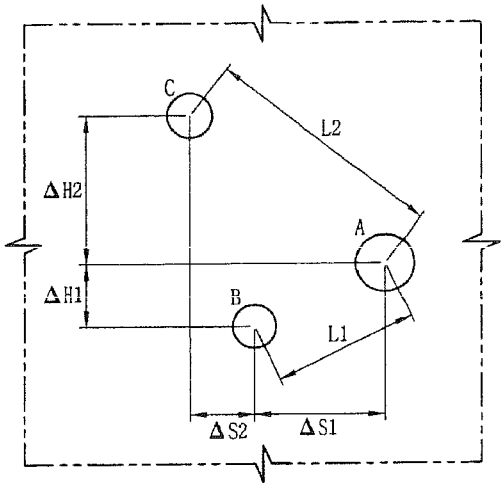
FIG. 9 is a planar view showing welded positions of the suction pipe and each connection pipe in the rotary compressor in accordance with FIG. 1.

The low pressure side connection pipe 510 may have another end connected to a first inlet of the first mode switching valve 540, and the high pressure side connection pipe 520 may have another end connected to a second inlet of the first mode switching valve 540. Also, the common connection pipe 530 may have another end connected to an outlet of the first mode switching valve 540. Both ends of the low pressure side connection pipe 510 may be welded with the gas suction pipe 140 and the first mode switching valve 540, respectively. Both ends of the high pressure side connection pipe 520 may be welded with the casing 100 (more particularly, an intermediate connection pipe sealing-coupled to the inner space of the casing 100) and the first mode switching valve 540, respectively. Both ends of the common connection pipe 530 may be welded with the intermediate bearing 130 (more particularly, an intermediate connection pipe sealing-coupled to the intermediate bearing 130) and the first mode switching valve 540, respectively. Here, as shown in FIGS. 8 and 9, preferably, a distance L1 between a first position A where the gas suction pipe 140 is connected to the casing 100 and a second position B where the common connection pipe 530 is connected to the casing 100 is not longer, more particularly, shorter than a distance L2 between the position A and a third position C where the high pressure type connection pipe 520 is connected to the casing. Accordingly, the second suction hole 412 may be radially formed and also located near the second vane slot 411, resulting in an increase in the volume of the compression space.

The positions, namely, first position A, second position B and third position C are preferably disposed to have therebetween different longitudinal distances ΔH1 and ΔH2 and different horizontal distances ΔS1 and ΔS2 such that the three positions A, B and C cannot overlap with one another on the same level. Hence, when welding the gas suction pipe 140 and each of the connection pipes 520 and 530, an interval great enough to be welded by a spot welding robot can be ensured so as to enable an automatic welding. In particular, because the first position A and the second position B may be located close to each other, an appropriate interval should be ensured between the two positions A and B for the welding automation.

The high pressure side connection pipe 520 may be communicated with a lower portion of the casing 100, namely, to a lower side than the second compression part 400. In this case, oil within the casing 100 is excessively introduced into the vane chamber 413 so as to delay the change in the pressure of the vane chamber 413 upon the mode switching of the compressor, which results in aggravating the vane vibration and additionally increasing a viscosity index between the second vane slot 411 and the second vane 430 to thereby obstruct the smooth operation of the vane. Therefore, the high pressure side connection pipe 520 may preferably be high enough not to be sunk in the oil, namely, be communicated between the lower end of the motor part 200 and the upper end of the first compressor 300, as shown in FIG. 1, such that the discharge pressure refrigerant filled in the inner space of the casing 100 can be introduced into the first mode switching valve 540. In this case, a predetermined amount of oil should be supplied into the vane chamber 413 to lubricate between the second vane slot 411 and the second vane 430, so a fine oil supply hole (not shown) may be formed at the lower bearing 130 so as to supply oil when the second vane 430 performs a reciprocating motion.

The first inlet of the first mode switching valve 540 is connected to the middle portion of the suction pipe 140 via the low pressure side connection pipe 510, and the second inlet of the first mode switching valve 540 is connected to the inner space of the casing 100 via the high pressure side connection pipe 520. Also, the outlet of the first mode switching valve 520 is connected to the vane chamber 413 of the second cylinder 410 via the common connection pipe 530. The first mode switching valve 540, as shown in FIGS. 1 to 3, may be disposed such that its central line in a lengthwise direction is approximately orthogonal to a central line of the casing 100 in its lengthwise direction or a central line of the accumulator 5 in its lengthwise direction. In some cases, the central line of the first mode switching valve 540 may be disposed approximately parallel to the central line of the casing 100 in its lengthwise direction or the central line of the accumulator 5 in its lengthwise direction.

Figure 10:
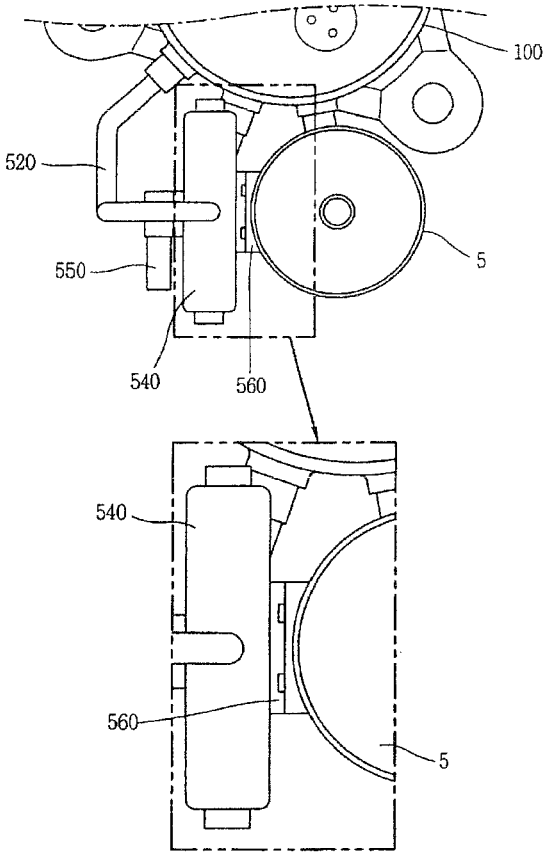
FIG. 10 is a planar view showing one embodiment of a fixed structure of an accumulator and a mode switching valve in the rotary compressor in accordance with FIG. 1.

The first mode switching valve 540, as shown in FIG. 10, may be disposed such that its one end can be fixed to an outer circumferential surface of the casing 100 or the accumulator 5 by using a supporting bracket 560 in a manner of welding or bolting. The supporting bracket 560 may be provided only one or in plurality in number.

The supporting bracket 560 should have a width maintained appropriately long enough to prevent the aggravation of the compressor vibration due to the mode switching valves 540 and 550. For example, the supporting bracket 560 may have at least a width L1 shorter than an outer diameter of the accumulator and shorter than the length L2 of the first mode switching valve. More accurately, the width L1 of the supporting bracket may preferably be longer than at least 8 mm to reduce the compressor vibration.

The supporting bracket 560 may be formed to be bilaterally symmetric based upon its center in the lengthwise direction. That is, preferably, the first mode switching valve 540 may be disposed such that the width direction center of the supporting bracket 560 matches with the center of the accumulator 5, and be fixed to be bilaterally symmetric based upon the width direction center of the supporting bracket 560, so as to enable the reduction of the compressor vibration.

In the meantime, the fixed position of the first mode switching valve 540 is associated with the vibration of the compressor 1. That is, as aforementioned, the first mode switching valve 540 may be welded or bolted to the casing 100 or the accumulator 5. Accordingly, the first mode switching valve 540 is spaced from the center of the compressor 1 including the accumulator 5 by a predetermined length so as to serve as a mass, thereby aggravating the vibration of the compressor. Hence, in order to attenuate the compressor vibration caused by the first mode switching valve 540, it is preferable to fix the first mode switching valve 540 to the accumulator 5 at a position, at which the compressor vibration can be minimized, namely, between the lower end and upper end of the accumulator 5.

Figure 11:
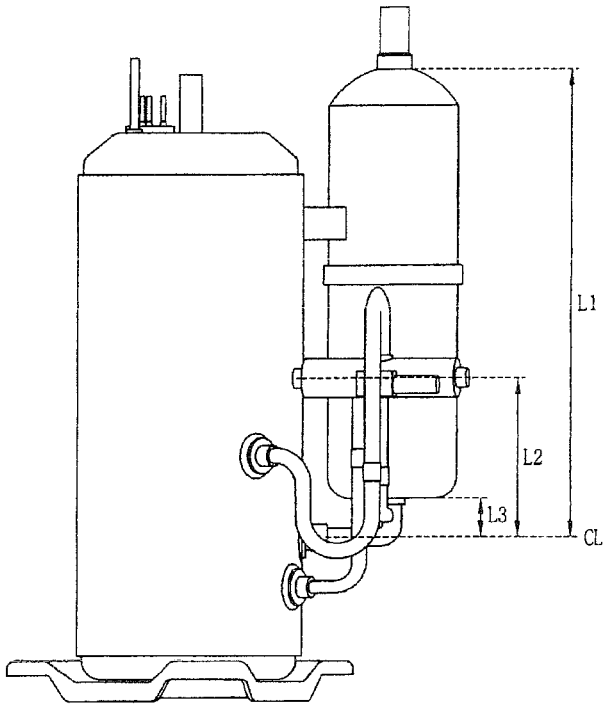
FIG. 11 is a front view showing assembled heights of the accumulator and the mode switching valve in the rotary compressor in accordance with FIG. 1.

For instance, as shown in FIG. 11, it may be preferable that a fixed point where the first mode switching valve 540 is fixed is positioned between both fixed points where the accumulator 5 is fixed to the casing 100 of the compressor 1. To this end, the first mode switching valve 540 may be installed at a position where a distance L2 between a reference height CL, at which the suction pipe is coupled to the casing, and the center of the first mode switching valve is shorter than a distance L1 between the reference height CL and the upper end of the accumulator and longer than a distance L3 between the reference height CL and the lower end of the accumulator 5. Here, the accumulator 5 may be fixed to be positioned higher than the center of the first cylinder 310 disposed at the relatively upper side.

Figure 12:
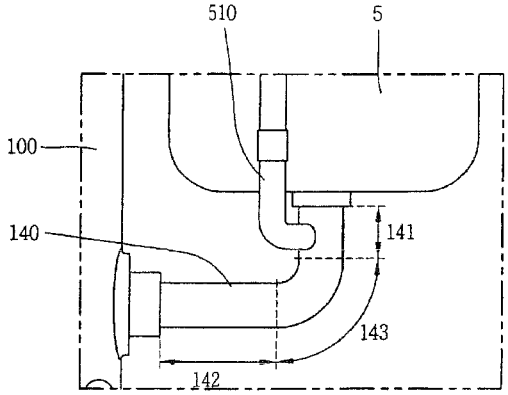
FIG. 12 is an enlarged view showing assembled positions of a suction pressure side connection pipe and the suction pipe of FIG. 11.

As shown in FIG. 12, the low pressure side connection pipe 510 for connecting the first inlet of the first mode switching valve 540 to the suction pipe 140 may be connected to a longitudinal portion 141 of the suction pipe 140, thereby further attenuating the compressor vibration caused by the accumulator 5. For instance, the suction pipe 140 may be formed in a shape like 'L' typically having the longitudinal portion 141, a horizontal portion 142 and a curved portion 143. An end of the longitudinal portion 141 may be fixed to the lower end of the accumulator 5 and an end of the horizontal portion 142 may be fixed to the side wall surface of the casing 100.

The low pressure side connection pipe 510 may be connected to the longitudinal portion 141. Accordingly, when the curved portion 143 is formed as shown for the suction pipe 140, another member should be welded with an interval more than a predetermined safety distance from the curved portion 143 so as to prevent the curved portion 143 from being broken. For instance, if the low pressure side connection pipe 510 is welded to the horizontal portion 142 of the suction pipe 140 for coupling, the horizontal portion 142 may become longer in length to maintain the safety distance, accordingly, the accumulator 5 is positioned much farther from the casing 100. Accordingly, a moment arm becomes longer as much more, which allows further aggravation of the compressor vibration.

Considering this, as shown in the embodiment of the present invention, the low pressure side connection pipe 510 may be welded to the longitudinal portion 141 of the suction pipe 140 so as to reduce the distance between the accumulator 5 and the casing 100 even if considering the safety distance, resulting in reducing the vibration of the compressor so much.

A basic compression process of the variable capacity type rotary compressor according to the present invention will be described hereinafter.

That is, when power is applied to the stator 210 of the motor part 200 and the rotor 220 is rotated accordingly, the rotation shaft 230 is rotated together with the rotor 220 so as to transfer the rotational force of the motor part 200 to the first compression part 300 and the second compression part 400. Within the first and second compression parts 300 and 400, the first rolling piston 320 and the second rolling piston 420 are eccentrically rotated respectively in the first compression space V1 and the second compression space V2, and the first vane 330 and the second vane 430 compress a refrigerant with forming the respective compression spaces V1 and V2 with a phase difference of 180° therebetween in cooperation with the first and second rolling piston 320 and 420.

For example, upon initiating a suction process in the first compression space V1, a refrigerant is introduced into the communication passage 131 of the intermediate bearing 130 via the accumulator 5 and the suction pipe 140. Such refrigerant is sucked into the first compression space V1 via the first suction hole 312 of the first cylinder 310 to be then compressed therein.

During the compression process within the first compression space V1, a suction process is initiated in the second compression space V2 of the second cylinder with the phase difference of 180° with the first compression space V1. Here, the second suction hole 412 of the second cylinder 410 is communicated with the communication passage 131 such that the refrigerant is sucked into the second compression space V2 via the second suction hole 412 of the second cylinder 410 to be then compressed therein.

In the meantime, a process of varying the capacity of the variable capacity type rotary compressor will be described hereinafter.

Figure 13:
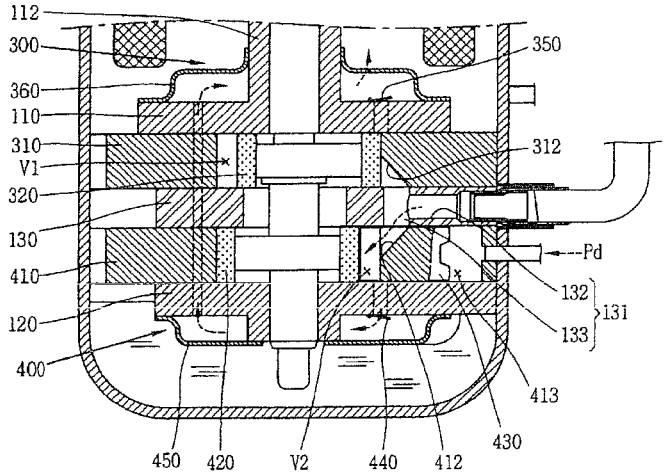
FIGS. 13 and 14 are longitudinal and horizontal cross-sectional views showing a power mode of the rotary compressor in accordance with FIG. 1.
Figure 14:
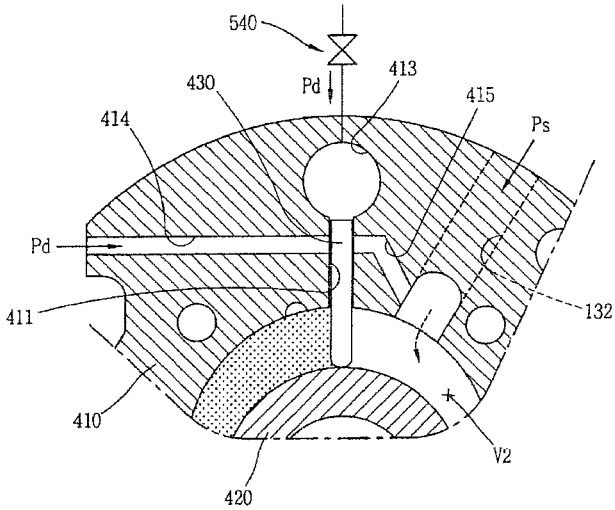

That is, even in case where the compressor or an air conditioner having the same is operated in a power mode, as shown in FIGS. 13 and 14, power is applied to the first mode switching valve 540, accordingly, the low pressure type connection pipe 510 is blocked while the high pressure type connection pipe 520 is connected to the common connection pipe 530. Accordingly, a high pressure gas within the casing 100 is supplied into the vane chamber 413 of the second cylinder 410 via the high pressure side connection pipe 520. The second vane 430 is then pushed by the high pressure refrigerant filled in the vane chamber 413 to be maintained in a state of being press-contacted with the second rolling piston 420. Hence, the refrigerant gas introduced into the second compression space V2 is normally compressed and discharged.

Here, the high pressure refrigerant gas or oil is applied via the first restricting passage 414 disposed in the second cylinder 410 so as to press one side surface of the second vane 430. However, as the sectional area of the first restricting passage 414 is narrower than that of the second vane slot 411, the pressure applied to the side surface of the second vane 430 is lower than the pressure applied thereto in back and forth directions within the vane chamber 413, accordingly the second vane 430 is not restricted. Therefore, the second vane 430 partitions the second compression space V2 into a suction chamber and a discharge chamber by being press-contacted with the second rolling piston 420, such that the entire refrigerant sucked into the second compression space V2 is compressed and discharged. Accordingly, the compressor or the air conditioner having the same can be operated with 100% of capacity.

Figure 15:
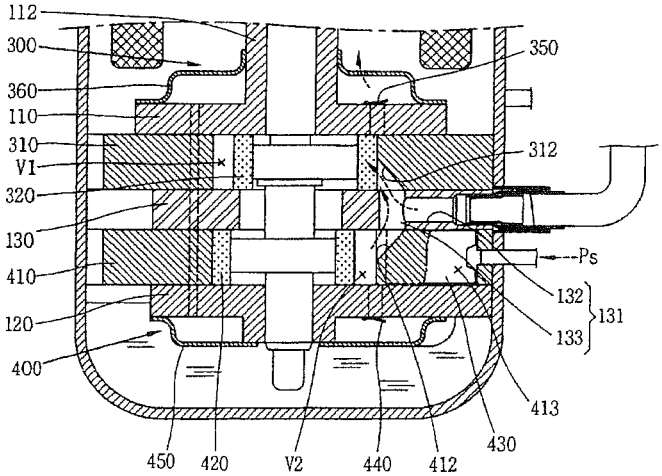
FIGS. 15 and 16 are longitudinal and horizontal cross-sectional views showing a saving mode of the rotary compressor in accordance with FIG. 1.
Figure 16:
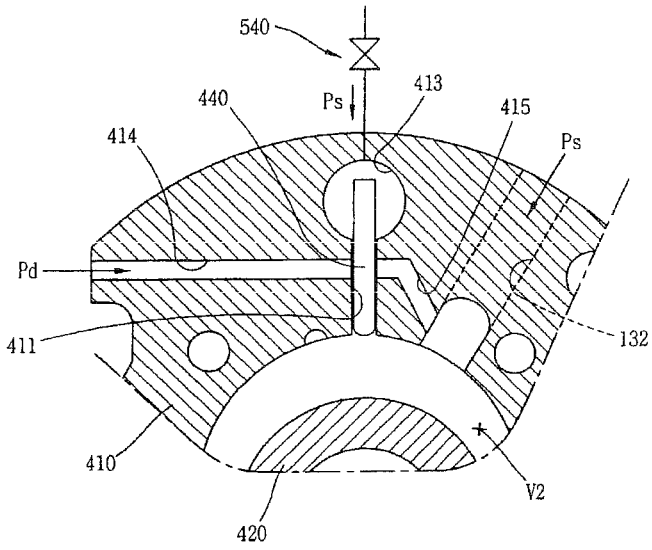

On the other hand, in a saving mode, such as upon initiating the compressor or the air conditioner having the same, as shown in FIGS. 15 and 16, power is not supplied to the first mode switching valve 540. Accordingly, contrary to the power mode, the low pressure side connection pipe 510 is communicated with the common connection pipe 530 and a lower pressure refrigerant (gas) sucked into the second cylinder 410 is partially introduced into the vane chamber 413. Consequently, the second vane 430 is pushed by the refrigerant compressed in the second compression space V2 so as to be accommodated within the second vane slot 411. The suction chamber and the discharge chamber of the second compression space V2 are accordingly communicated with each other, and thereby the refrigerant gas sucked into the second compression space V2 cannot be compressed.

Here, a great pressure difference occurs between the pressure applied to one side surface of the second vane 430 by the first restricting passage 414 disposed in the second cylinder 410 and the pressure applied to another side surface of the second vane 430 by the second restricting passage 415. Accordingly, the pressure applied via the first restricting passage 414 shows a tendency to move toward the second restricting passage 415, thereby rapidly restricting the second vane 430 without vibration. In addition, at the time when the pressure of the vane chamber 413 is converted from discharge pressure into suction pressure, the discharge pressure remains in the vane chamber 413 so as to form a type of intermediate pressure Pm. However, the intermediate pressure Pm of the vane chamber 413 is leaked via the second restricting passage 415 with pressure lower than that. Accordingly, the pressure of the vane chamber 413 is fast converted into the suction pressure Ps, resulting in much quickly preventing the vibration of the second vane 430. Hence, the second vane 430 can be restricted fast and effectively. Therefore, as the second compression space of the second cylinder 410 is communicated into one space, the entire refrigerant sucked into the second compression space V2 of the second cylinder 410 is not compressed but flows along the track of the second rolling piston. Part of the refrigerant is moved into the first compression space V1 via the communication passage 131 and the first suction hole 312 due to the pressure difference, so the second compression part 400 is not operated. Consequently, the compressor or the air conditioner having the same is operated only with the capacity of the first compression part. Also, during this process, the refrigerant within the second compression space V2 flows into the first compression space V1 without flowing back into the accumulator 5, thereby preventing the overheat of the accumulator 5, resulting in the reduction of suction loss.

As such, a refrigerant sucked via one suction pipe is alternately sucked into the respective compression spaces via the communication passage between a plurality of cylinders, so as to reduce the number of components required, as compared to coupling suction pipes independently to the respective cylinders and also reduce the number of assembly processes for connecting the suction pipes to the casing and the accumulator, thereby greatly reducing the fabricating cost.

Further, the plurality of cylinders are directly communicated with each other and one suction pipe is connected therebetween so as to prevent a refrigerant within an idling cylinder from flowing back into another cylinder, thereby improving the performance of the compressor. For instance, if the first cylinder and the second cylinder are connected via the accumulator, the second compression space of the second cylinder, which idles in the saving mode of the compressor, is communicated with the accumulator. Accordingly, a refrigerant, which is compressed to some degree within the second compression space, flows back into the accumulator and then sucked into the first compression space of the first cylinder. Consequently, a temperature of the accumulator is risen, which increases a specific volume of the refrigerant, which may cause a decrease in an amount of refrigerant sucked into the first compression space, thereby lowering the performance of the compressor. However, as shown in the present invention, when the first suction hole and the second suction hole are directly communicated via the communication passage of the intermediate passage without passing through the accumulator, in the saving mode of the compressor, the refrigerant is rarely introduced into the second compression space but mostly sucked only into the first compression space in a relatively low pressure atmosphere, thereby preventing the increase in the specific volume of the refrigerant sucked in the first compression space, resulting in improving the performance of the compressor. Actually, as a result of measuring an internal temperature of the accumulator in the saving mode, it was found out that the detected internal temperature of the accumulator is about 50° C. when both cylinders are connected to each other via the accumulator while the internal temperature of the accumulator is maintained at about 35° C. when they are connected to each other without the accumulator. It can be determined that both cylinders are connected to respective suction pipes and the plural suction pipes are connected via one accumulator so that a refrigerant flows back to the accumulator via the suction pipe connected to a cylinder idling in the saving mode and accordingly the temperature of the accumulator is risen. On the other hand, it can also be determined that in case where the cylinders are directly connected to each other via one suction pipe, a refrigerant is continuously sucked only into a cylinder maintained in a relatively low pressure state of both of the cylinders so that the backflow of a refrigerant within the idling cylinder rarely occurs. Therefore, it can be noticed that the overall performance of the compressor is improved.

Furthermore, owing to the connection of one suction pipe, upon connecting other connection pipes (particularly, common connection pipe) constructing a mode switching unit as well as the suction pipe, a welding space required for the operation of a welding robot can be ensured so as to realize a welding automation, resulting in remarkable reduction of the fabricating cost. As shown in the aforesaid example, for employing a plurality of suction pipes, one of the plurality of suction pipes is disposed near the common connection pipe, accordingly, a welding space for a spot welding robot performing welding by typically using 3 or 4 torches cannot be ensured, resulting in impossibility of the welding automation. Accordingly, an operator should directly weld each of the suction pipes and the connection pipes, so such operation is slowly performed as much more, which may cause an excessive increase in the fabricating cost. Thus, when one suction pipe is employed as in the present invention, the welding space of the spot welding robot is secured, thereby enabling automation of welding the suction pipe and the connection pipes. Consequently, when fabricating the variable capacity type rotary compressor, an assembly process of assembling a mode switching unit is simplified and fast performed, so as to remarkably reduce the fabricating cost.

In addition, the mode switching valve is supported by being coupled to the accumulator by a supporting bracket, thereby preventing an increase in the compressor vibration due to the mode switching valve. In particular, the bracket is designed to have a width more than a preset reference value so as to support the mode switching valve, thereby further reducing the compressor vibration. In addition, the mode switching valve can be fixed at a position where the accumulator does not amplify the compressor vibration, namely, between both fixed points where the amplitude of the accumulator may be the lowest, thereby reducing the compressor vibration due to the mode switching valve.

Furthermore, the mode switching valve is connected to the longitudinal portion of the suction pipe so as to prevent the accumulator from being apart from a center of gravity of the compressor, thereby reducing the compressor vibration.

In the meantime, the previous embodiment illustrated that the vane chamber is formed outside the second vane slot to restrict or release the second vane; however, in some cases, the vane chamber may be formed outside the first vane slot and communicated with the inner space of the casing outside the second vane slot. In this case, the first vane may be press-contacted with or spaced apart from the first rolling piston according to a pressure difference applied onto its pressed surface so that the first compression part can normally compress a refrigerant or be idled. However, even in this case, the gas suction pipe is provided only one in number and also the common connection pipe and the gas suction pipe have preset intervals in horizontal and longitudinal directions. The operational effects according to such configuration are similar to the previous embodiment. Therefore, a detailed description thereof will be understood by the description of the previous embodiment.

Meanwhile, the fixing method and fixed position of the mode switching valve may be equally applied to fixing it to the casing other than the accumulator.

INDUSTRIAL APPLICABILITY

The variable capacity type rotary compressor in accordance with the present invention may be widely applied to cooling apparatuses such as home or commercial air conditioners.

The invention claimed is:

1. A variable capacity type rotary compressor, comprising:

a casing having a hermetic inner space;

an accumulator coupled to one side of the casing via a suction pipe;

at least one compressor installed in the inner space of the casing, connected to the accumulator via the suction pipe, and configured to compress a refrigerant sucked via the accumulator;

a drive motor installed in the inner space of the casing and configured to drive the at least one compressor; and a mode switching valve installed outside the casing and configured to vary an operation mode of the at least one compressor, wherein the at least one compressor comprises:

a plurality of cylinders installed in the inner space of the casing and having a plurality of compression spaces, respectively;

a plurality of rolling pistons that orbits within the respective plurality of compression spaces of the plurality of cylinders to compress the refrigerant; and a plurality of vanes configured to partition the plurality of compression spaces of each of the plurality of cylinders into a suction space and a discharge space together with the plurality of rolling pistons, respectively, wherein the plurality of cylinders includes a plurality of suction holes, which communicates with each other via a communication passage, wherein the suction pipe is connected to the communication passage such that the refrigerant is distributed into the plurality of cylinders, wherein the mode switching valve is fixed to the accumulator to be disposed between lower and upper ends of the accumulator, wherein the mode switching valve comprises at least two inlets and at least one outlet, wherein the at least two inlets and the at least one outlet are fixed to ends of different connection pipes, respectively, and wherein an end of at least one of the connection pipes is fixed to the casing and an end of another of the connection pipes is fixed to an outer circumferential surface of the suction pipe.

2. The compressor of claim 1, wherein the accumulator is coupled to the casing at at least two fixed positions in a lengthwise direction of the accumulator.

3. The compressor of claim 2, wherein the mode switching valve is installed at a position at which a distance L2 between a reference height CL at which the suction pipe is coupled to the casing and a center of the mode switching valve is less than a distance L1 between the reference height CL and the upper end of the accumulator and greater than a distance L3 between the reference height CL and the lower end of the accumulator.

4. The compressor of claim 3, wherein the accumulator is coupled to be positioned higher than a center of the plurality of compression spaces of the at least one compressor.

5. The compressor of claim 1, wherein the suction pipe is curved to have a longitudinal portion and a horizontal portion, and wherein the connection pipe is connected to the longitudinal portion of the suction pipe.

6. The compressor of claim 1, wherein a chamber is disposed in one of the plurality of cylinders and configured to support its respective vane by refigerant suction pressure or discharge pressure within the chamber, and wherein the chamber is isolated within the inner space of the casing.

7. The compressor of claim 1, wherein the chamber is connected to the at least one outlet of the mode switching valve via the connection pipe.

8. The compressor of claim 1, wherein at least one of the plurality of vanes is restricted by a pressure of the inner space of the casing.

9. The compressor of claim 1, wherein the mode switching valve is disposed such that a central line in a lengthwise direction thereof is approximately parallel with a virtual line connecting a center of the casing to a center of the accumulator.

10. The compressor of claim 1, wherein the mode switching valve is disposed such that a central line in a lengthwise direction thereof is approximately orthogonal to a virtual line connecting a center of the casing to a center of the accumulator.

11. The compressor of claim 1, further comprising:

a low pressure side connection pipe diverged from the suction pipe;

a high pressure side connection pipe connected to the hermetic inner space of the casing; and a common connection pipe connected to the chamber so as to selectively communicate with the low pressure side connection pipe and the high pressure side connection pipe, wherein a distance between a first position A where the suction pipe is connected to the casing and a second position B where the common connection pipe is connected to the casing is less than a distance between the position A and a third position C where the high pressure side connection pipe is connected to the casing.

12. The compressor of claim 1, wherein the communication passage comprises:

a horizontal path formed in a radial direction that communicates with the suction pipe; and a longitudinal path formed at an end of the horizontal path such that each of the plurality of suction holes communicates with the horizontal path through the longitudinal path.

13. The compressor of claim 1, wherein each of the plurality of suction holes is formed with an inclination angle by chamfering respective edge surfaces of the plurality of cylinders toward inner circumferential surfaces thereof.

14. The compressor of claim 1, wherein the plurality of suction holes extends in a radial direction of the plurality of cylinders.

* * * * *